United States Patent [19]

Brisco et al.

[11] Patent Number: 5,074,361

[45] Date of Patent: Dec. 24, 1991

[54] RETRIEVING TOOL AND METHOD

[75] Inventors: David P. Brisco; Donald F. Hushbeck, both of Duncan, Okla.

[73] Assignee: Halliburton Company, Duncan, Okla.

[21] Appl. No.: 528,638

[22] Filed: May 24, 1990

[51] Int. Cl.[5] ..... E21B 31/16; E21B 31/20

[52] U.S. Cl. ..... 166/301; 166/98; 166/240; 166/376; 166/377; 294/86.21; 294/86.34

[58] Field of Search ..... 166/377, 376, 301, 98, 166/240; 294/86.12, 86.13, 86.17, 86.21, 86.33, 86.34

[56] References Cited

U.S. PATENT DOCUMENTS

| | | | |
|---|---|---|---|
| 1,528,561 | 3/1925 | Nixon | 294/86.21 |
| 2,070,869 | 2/1937 | Sorensen | 294/86.21 |
| 2,762,438 | 9/1956 | Naylor | 166/301 X |
| 2,915,289 | 12/1959 | Lawrence | 166/98 X |
| 3,019,840 | 2/1962 | Kennard | 294/86.34 X |
| 3,095,926 | 7/1963 | Rush | 294/86.34 X |
| 3,120,871 | 2/1964 | De Cordova | 294/86.34 |
| 3,747,674 | 7/1973 | Murray | 166/98 |
| 4,185,689 | 1/1980 | Harris | 166/133 |
| 4,254,983 | 3/1981 | Harris | 294/86.21 |

OTHER PUBLICATIONS

Bowen Tools, Inc. Instruction Manual No. 5/2710 entitled "Bowen Simplex Packer Retrievers", 7th printing, dated Jun. 1974.

*Primary Examiner*—Hoang C. Dang
*Attorney, Agent, or Firm*—C. Dean Domingue

[57] ABSTRACT

A tool and method for use with a drill string or the like in capturing an object in a cavity, such as subterranean borehole, include a mandrel, object engaging apparatus for latching the mandrel to the object as the tool is moved into the borehole, and string engaging apparatus for keeping the mandrel latched to the drill string as the mandrel is moved into the borehole and for unlatching the mandrel from the drill string when the drill string is rotated in a first direction with the mandrel latched to the object. A washover pipe and mill, which are connected to the drill string, may be moved into contact with the object after the mandrel is unlatched from the drill string for milling through the object. A ratchet allows the mill to move toward the object relative to the mandrel and prevents the mill from moving away from the object relative to the mandrel. The ratchet allows the mill to move away from the object when the drill string is rotated in the first direction and lifted relative to the mandrel. The string engaging assembly relatches the mandrel to the drill string when the drill string is moved away from the object and rotated in a second direction. The object engaging apparatus unlatches the mandrel from the object when the mandrel is moved away from the object and rotated in the second direction.

7 Claims, 7 Drawing Sheets

RETRIEVING TOOL AND METHOD

BACKGROUND OF THE INVENTION

This invention relates to a tool and method for capturing an object in a cavity, and more particularly, but not by way of limitation, relates to apparatus and method adapted for retrieving a packer from a subterranean borehole.

A sealing device, commonly referred to as a "packer" is often used in a subterranean borehole or well to seal off or plug a zone or zones of the borehole. It is often necessary to remove the packer from the borehole. This is typically accomplished using a rotary drill or rotary milling tool to "drill up" or "mill up" the packer. The milling tool or mill is normally lowered into the borehole on a drill string until it contacts the packer at which time it is rotated to mill away the outer edge of the packer, thereby freeing the packer from the borehole. This milling process leaves large pieces of the packer between the mill and the core of the packer. The pieces will fall into the borehole if the mill is lifted or moved relative to the packer in such a manner that the pieces are not contained by the mill.

If the debris from the milled packer is allowed to fall into the borehole during the milling operation, the debris may damage other tools and the like which are located below the packer in the well. The debris may also be blown out of the well at a later time and cause damage to the tools and the equipment located at the wellhead. It is therefore desirable to provide a means for containing the debris created by the milling operation. It is also desirable to provide a retrieving tool and method which operates simply and reliably with a minimal number of moving parts and which will capture and release the packer with minimal manipulation of the drill string and tool.

The prior art includes numerous apparatus for retrieving a packer and for catching the packer once it is freed from the borehole. This is particularly so of the "bridge plug"-type packer. Most of the prior art apparatus include a central stinger which is passed through a central bore of a packer and which includes a central mandrel with a sliding sleeve disposed thereon having resilient spring fingers. After passing downward through the packer, the sliding sleeve drops down to an enlarged diameter tapered surface of the mandrel causing expansion of the spring fingers so that they will not pass upwards through the packer bore.

One particular example of such a prior art retrieving tool is manufactured by Bowen Tools, Inc. and is illustrated in their Instruction Manual No. 5/2710 entitled "Bowen Simplex Packer Retrievers", 7th printing, dated June 1974.

The Bowen device is a rotary mill-type packer retrieving tool that consists of a washover-type mill shoe and a centrally located spear that passes through the packer mandrel bore. The spear or central mandrel has a cantilever finger collet sleeve with expanding fingers pointed in a downward direction. After the stinger passes through the packer bore, the collet sleeve drops down to an enlarged diameter tapered surface or wedge. This causes expansion of the sleeve fingers, thus causing the diameter increase which will not pass back through the packer bore, thereby creating a shoulder which catches the packer mandrel so that the packer may be retrieved. This expanded diameter also serves to catch the packer or bridge plug after milling away the outer slips that hold the packer in place with the borehole. The milled packer is then retrieved from the borehole.

Another example of a prior art retrieving tool is disclosed in U.S. Pat. No. 4,254,983, invented by Harris, and assigned to the present applicant (the Halliburton Company). The Harris patent reverses the orientation of the collet sleeve used by the Bowen device so that the spring fingers are extended upwardly. The outside diameter of the flexible collet sleeve fingers is larger than that of the inner bore of the packer through which the Harris retrieving tool is to be stabbed. Consequently, the initial stab-in of the retrieving tool stinger requires compressing the fingers to cause their diameter to contract by applying a downward force. The fingers then expand to their normal larger outside diameter after passing through the packer bore thus creating an interference or catcher shoulder with respect to the packer mandrel when retrieving tool is pulled upward.

Another retrieving tool is disclosed in U.S. Pat. No. 3,095,926, issued to Rush. In the Rush apparatus, the stinger or spear does not pass through the packer but uses a bowspring and slip mounted on a cage on the end of the spear. The spear must be lowered into the packer to move the cage to the upper end of the spear. The tool must be rotated to release the cage from the upper end of the spear and then lifted to pull a slip expander up into the cage, thereby expanding the slips to secure the spear inside the packer.

Shortcomings of the prior retrieving tools include their complexity, i.e., the use of a sliding cage, fingers, slips, etc. which increase cost and the number of components which may fail; and that the mill does not contain the loose pieces of the milled packer.

Therefore, there is a need for apparatus and method which provide a retrieving tool of simplified structure and which will contain loose pieces of a milled packer.

SUMMARY OF THE INVENTION

The present invention is contemplated to overcome the foregoing shortcomings and meet the above described needs. For accomplishing this, the present invention provides a novel and improved tool and method for capturing an object in a cavity, such as a packer in a subterranean borehole.

The tool includes a mandrel, object engaging means for latching the mandrel to the object as the tool is moved into the borehole, and string engaging means for keeping the mandrel latched to the drill string as the mandrel is moved into the borehole and for unlatching the mandrel from the drill string when the drill string is rotated in a first direction with the mandrel latched to the object. The drill string may be moved into contact with the object after the mandrel is unlatched from the drill string. Preferably, the drill string includes a washover pipe connected to the drill string and a mill connected to the washover pipe. The washover pipe and mill are rotatable with the drill string for milling through the object.

Ratchet means is provided for allowing the washover pipe and mill to move toward the object relative to the mandrel and to prevent the washover pipe and mill from moving away from the object relative to the mandrel. The ratchet means locks the washover pipe and mill over the milled packer in order to contain loose pieces of the packer between the washover pipe and the packer. The ratchet means also allows the washover pipe and mill to move away from the object relative to the mandrel when the drill string is rotated in the first direction relative to the mandrel in order to release the ratchet means and to move the washover pipe and mill away from the object and relative to the mandrel, when so desired.

To disengage the tool from the packer or object, after the ratchet means is released, the drill string is moved away from the object and rotated in a second direction relative to the mandrel in order to latch the mandrel to the drill string with the string engaging means. The object engaging means will then unlatch the mandrel from the object when the mandrel is moved away from the object and rotated in a second direction relative to the object. The tool may then be removed from the borehole, free of the object or packer.

The method of capturing an object in a cavity, such as a packer in a subterranean borehole, using a drill string or the like includes moving a mandrel into the borehole with a drill string; latching the mandrel to the object as the tool is moved into the borehole; and rotating the drill string in a first direction with the mandrel latched to the object in order to unlatch the mandrel from the drill string. Preferably, the drill string is first moved away from the object after the mandrel is latched to the object and then the drill string is moved toward the object and rotated in the first direction to unlatch the mandrel from the drill string. The drill string may be moved into contact with the object after the mandrel is unlatched from the drill string. Once in contact with the object, the drill may be rotated to mill through the object.

The method allows the drill string to move toward the object relative to the mandrel and prevents the drill string from moving away from the object relative to the mandrel when the drill string is unlatched from the mandrel and the mandrel is latched to the object. The method also allows the drill string to move away from the object relative to the mandrel when the drill string is rotated in the first direction relative to the mandrel.

BRIEF DESCRIPTION OF THE DRAWINGS

The present invention will be better understood by reference to the example of the following drawings:

FIG. 8 is a view of an embodiment of the string engaging means of the present invention.

DETAILED DESCRIPTION OF THE PREFERRED EMBODIMENTS

FIGS. 1–11 present embodiments of the tool and method, generally designated 20, for capturing an object in a cavity. As exemplified in FIGS. 1-11, in the preferred embodiments, the tool and method 20 (hereinafter collectively referred to as "tool") are used in removing a packer (in the prototype, a drillable, treat, test, squeeze ("DTTS" ) packer) from a subterranean borehole. It is intended to be understood that the tool 20 may be used to capture various objects lodged in various types of cavity.

Figures 1A, 1B, 1C:
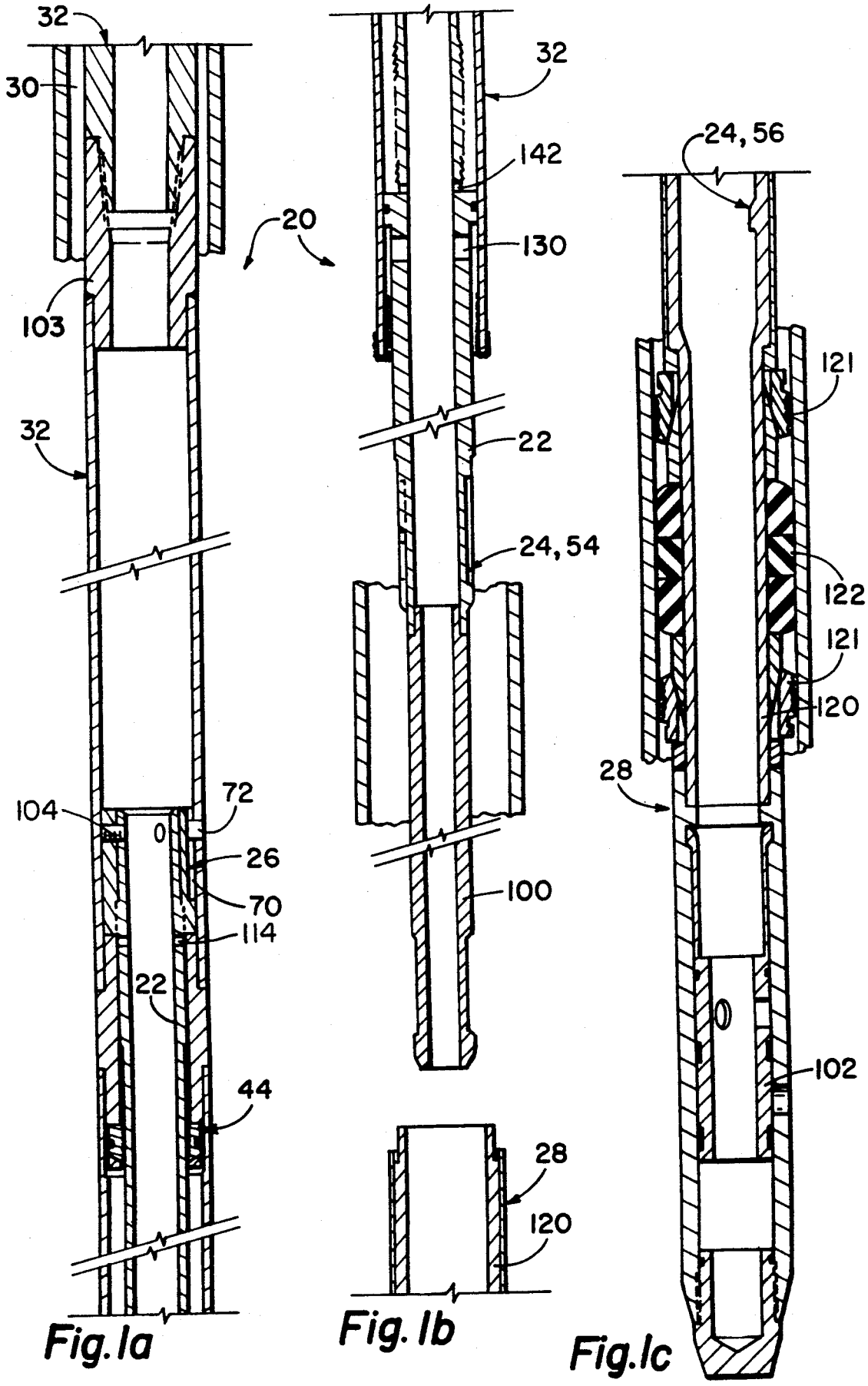
FIGS. 1*a*–1*c* are a cross-sectional view of an embodiment of the tool of the present invention suspended in a borehole above a packer.
Figure 5A:
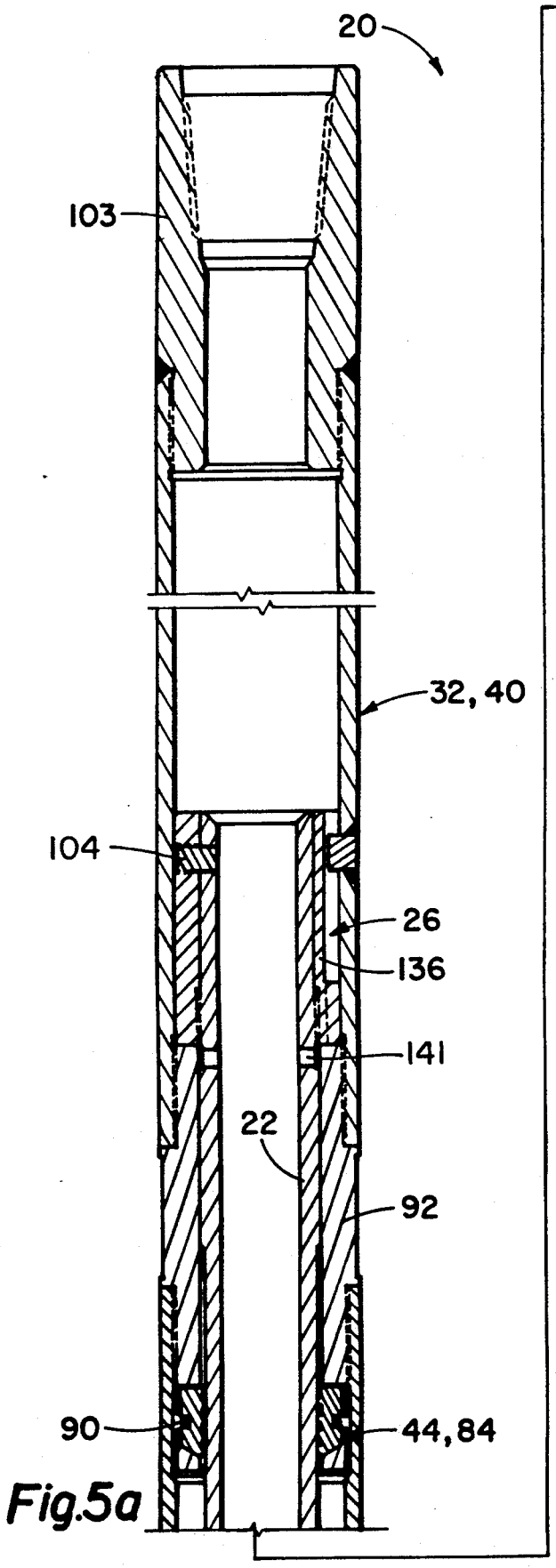
FIGS. 5*a*–5*b* are a cross-sectional view of an embodiment of the tool of the present invention.
Figure 5B:
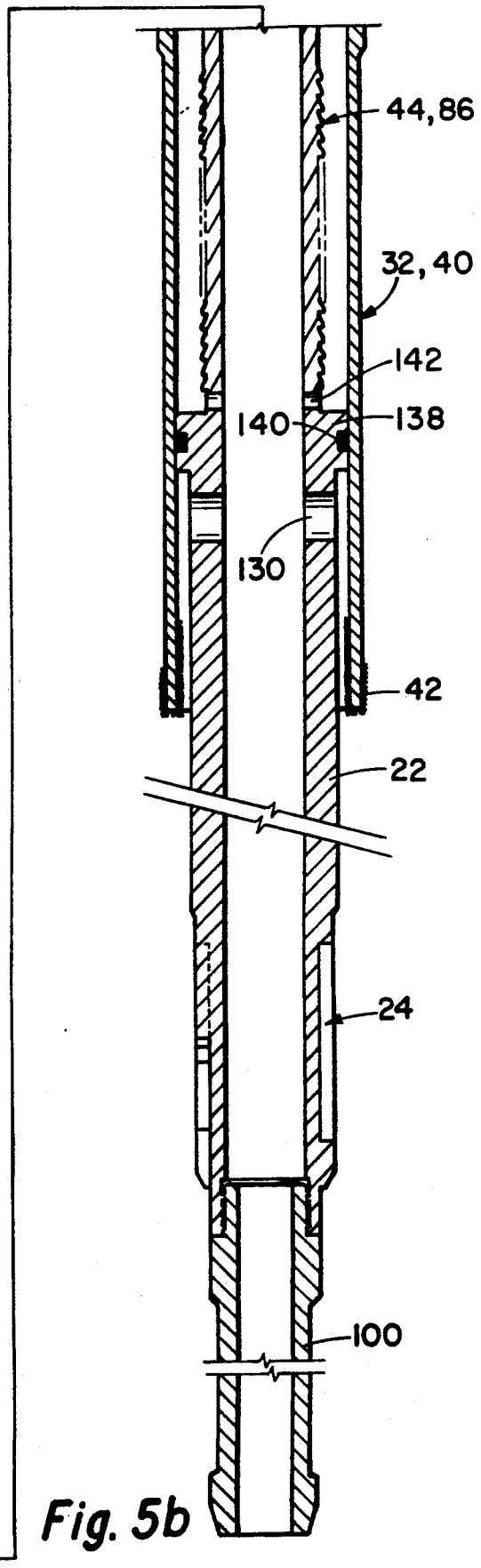

Referring to the example of FIGS. 1 and 5, the tool 20 of the present invention may be generally described as comprising a mandrel 22, object engaging means 24, and string engaging means 26. The object engaging means 24 is used for latching the mandrel 22 to the object or packer 28 as the tool 20 is moved into the borehole 30, as exemplified in FIG. 2. The string engaging means 26 keeps the mandrel 22 latched to the drill string 32 as the mandrel 22 is moved into the borehole 30 and unlatches the mandrel 22 from the drill string 32 when the drill string 32 is rotated in a first direction with the mandrel 22 latched to the object 28, as exemplified in FIG. 3. By rotated in a first direction is meant rotated in a first direction around the longitudinal axis of the borehole 30 and the drill string 32.

In the preferred embodiment, the string engaging means 26 unlatches the mandrel 22 from the drill string 32 as the drill string 32 is moved toward the object 28 and rotated in the first direction after having been moved away from the object 28 with the mandrel 22 latched to the object 28.

Figure 3A:
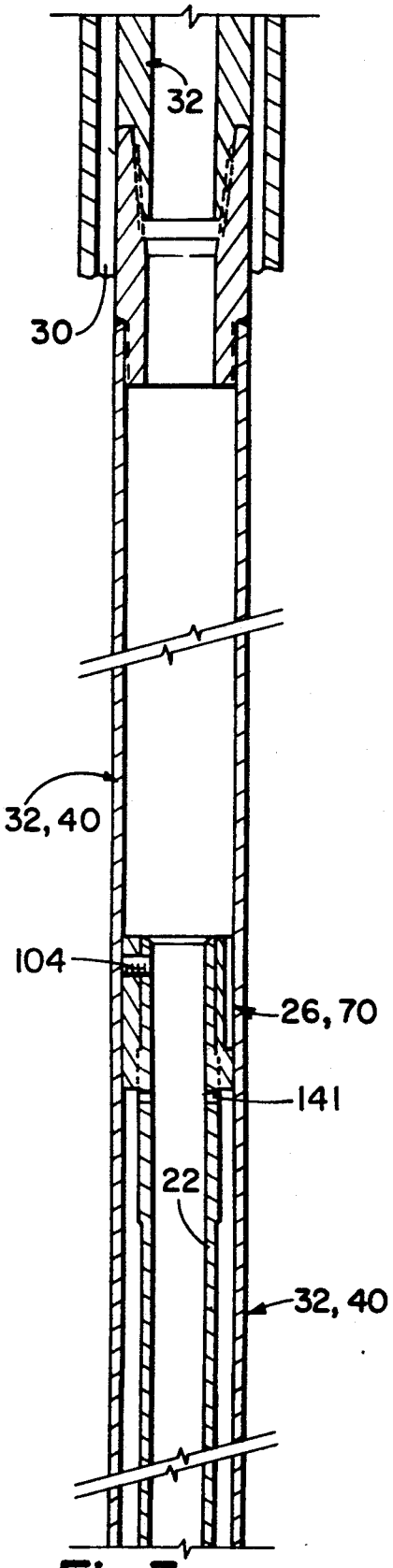
FIGS. 3*a*–3*c* are is another view of the tool of FIG. 1 in which the washover pipe and mill have been disengaged from the mandrel and the mill has been moved downward into engagement with the top end of the packer.
Figure 3B:
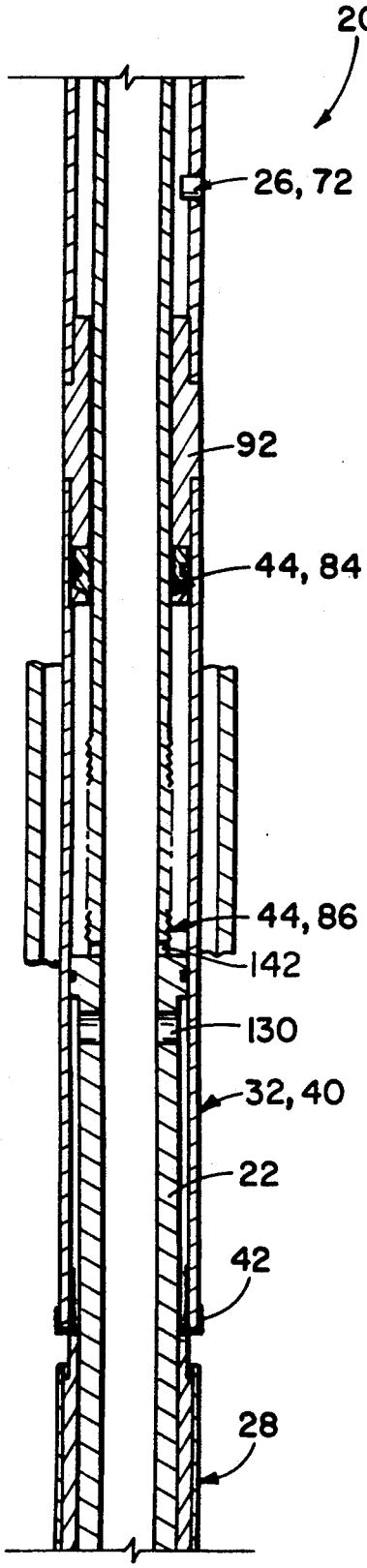
Figure 3C:
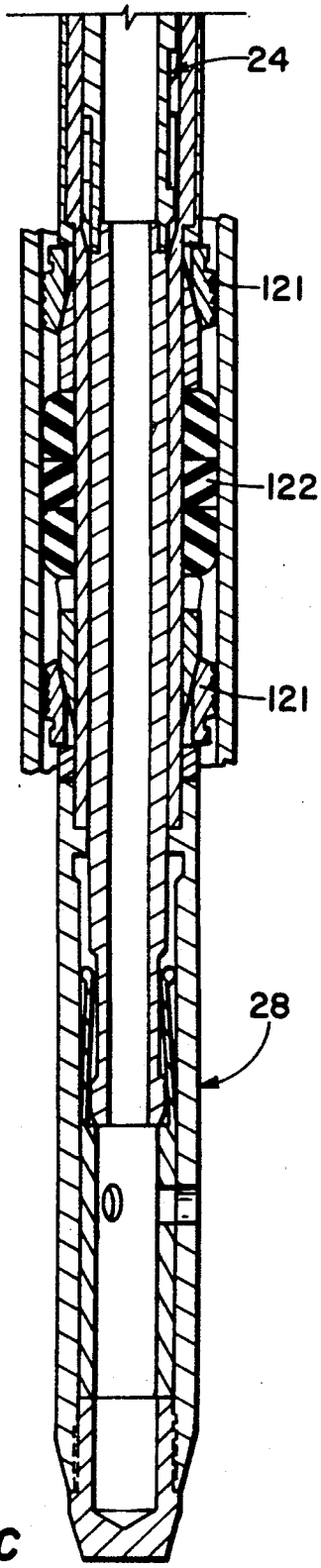

As exemplified in FIG. 3, the drill string 32 may be moved into contact with the object 28 after the mandrel 22 is unlatched from the drill string 32. Preferably, the drill string 32 includes a washover pipe 40 connected to the lower end of the drill string 32 and the washover pipe 40 may be moved into contact with the object 28 after the mandrel 22 is unlatched from the drill string 32. More preferably, the washover pipe 40 includes a mill 42, connected to the lower end of the washover pipe 40, which is rotatable with the drill string 32 and the washover pipe 40 for milling through the object or packer 28, as further discussed below. "Washover pipe" is a term of art in the drilling industry which describes a tubular accessory used in retrieving operations to go over the outside of tubing, drill pipe, or other objects stuck in a borehole because of cuttings, mud, and so forth that have collected in the annulus, i.e, the annular space outside of the stuck object. The washover pipe is used to clean the annular space and permit recovery of the pipe or other object which is stuck in the borehole. When used with the tool 20, the washover pipe 40 and mill 42 extend over the mandrel 22 into contact with the packer 28 and allow drilling fluid to be circulated through the mill 42, as further discussed below.

Referring to the example of FIG. 5, in the preferred embodiment, the tool 20 includes ratchet means 44 for allowing the washover pipe 40 and mill 42 to move toward the object 28 relative to the mandrel 22, i.e., the washover pipe 40 and mill 42 move toward the object 28 while the mandrel 22 remains latched to the packer 28 and essentially stationary, and for preventing the washover pipe 40 and mill 42 from moving away from the object 28 relative to the mandrel 22. The ratchet means 44 includes means for allowing the washover pipe 40 and mill 42 to move away from the object 28 relative to the mandrel 22 when the drill string 32 is rotated in the first direction relative to the mandrel 22, as will be further discussed below.

As will also be discussed below, the string engaging means 26 latches the mandrel 22 to the drill string 32 when the drill string 32 is moved away from the object 28 and rotated in a second direction relative to the mandrel 22. The object engaging means 24 unlatches the mandrel 22 from the object 28 when the mandrel 22 is moved away from the object 28 and rotated in the second direction relative to the object 28. In the preferred embodiment, the second direction of rotation is opposite to the first direction of rotation. The first direction should be the same direction as the drill string 32 is turned when drilling the borehole 30 and when milling the packer 28. Therefore, according to traditional drilling industry practice, the first direction will normally be clockwise as viewed from the top and the second direction will normally be counter-clockwise as viewed from the top of the borehole 30 and drill string 32.

Figure 2A:
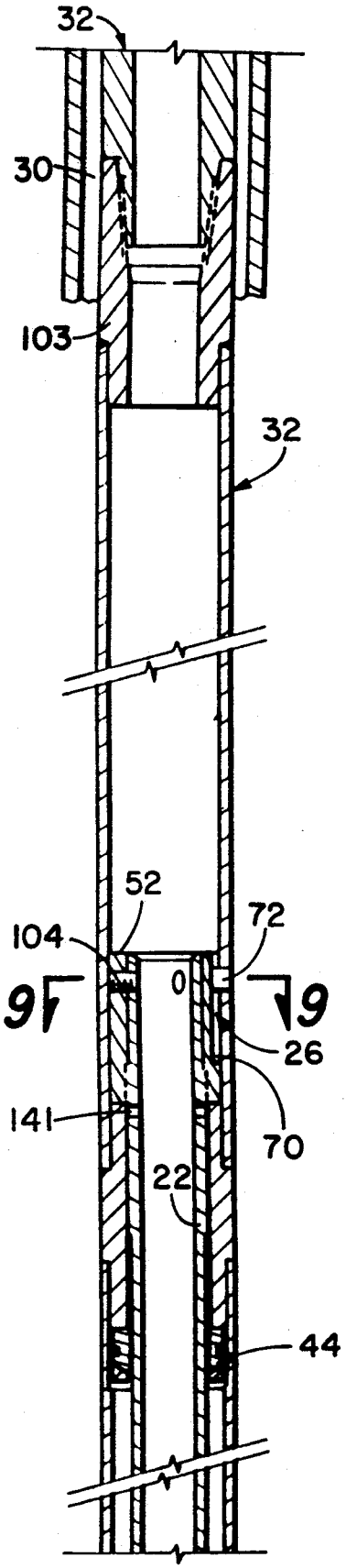
FIGS. 2*a*–2*c* are another view of the tool of FIG. 1, with the tool having been moved downward so that the tool has engaged packer and shifted the valve of the packer to the open position.
Figure 2B:
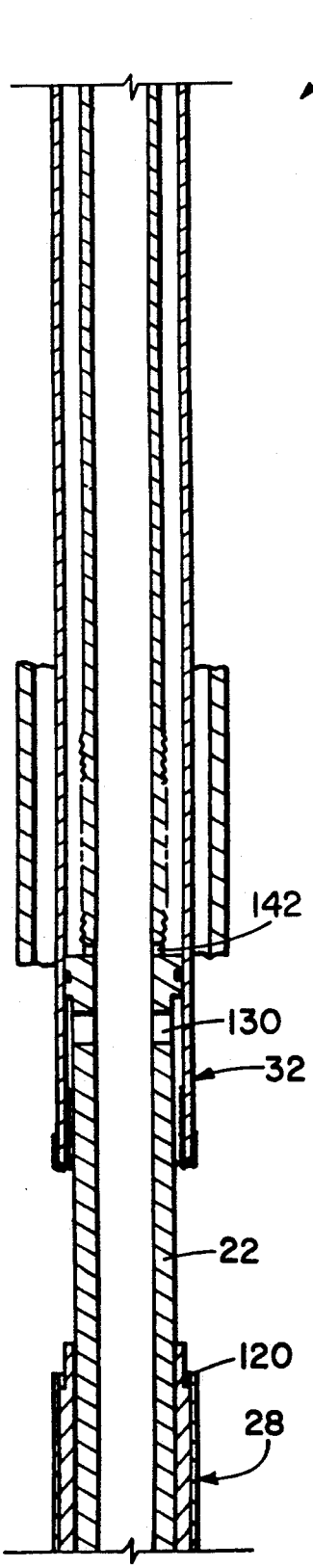
Figure 2C:
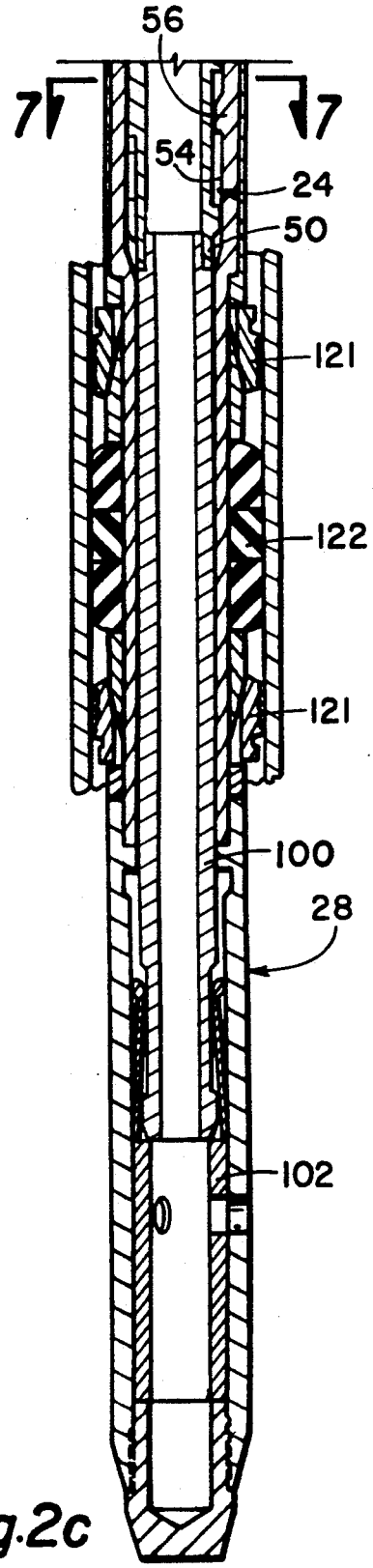

Referring to the example of FIG. 2, in the prototype tool 20, the object engaging means 24 is located at the lower end 50 of the mandrel 22 for latching the mandrel 22 to the object 28 as the tool 20 is lowered into the borehole 30 and for keeping the mandrel 22 latched to the object 28 when the mandrel 22 is raised, lowered, or rotated in the first direction relative to the object 28. Also in the prototype tool 20, the string engaging means 26 is located at the upper end 52 of the mandrel 22 for keeping the mandrel 22 latched to the drill string 32 as the mandrel 22 is lowered into the borehole 30 and for unlatching the mandrel 22 from the drill string 32 when the drill string 32 is raised and then lowered and rotated in the first direction with the mandrel 22 latched to the object 28.

The object engaging means 24 and string engaging means 26 may be threaded connections, ratcheted connections, as well as other types of mechanical connections. In the prototype tool 20, referring to the example of FIG. 6, the object engaging means 24 includes a J-slot 54 located in one of the lower end 50 of the mandrel 22 or in the object 28; and a lug 56 located in the other of the lower end 50 of the mandrel 22 or in the object 28. Preferably, as exemplified in FIGS. 1 and 2, the lug 56 is located in the inside wall of the object or packer 28 and the J-slot 54 is located in the outside wall of the lower end 50 of the mandrel 22. In the prototype tool 20, the object engaging means includes three J-slots 54 spaced around the lower end of the mandrel 22 in a common radial plane and three lugs 56 spaced around the upper end of the packer 28 in a common radial plane, as exemplified in FIG. 7. Preferably, referring to the example of FIG. 6, the J-slots 54 are automatic, i.e., the J-slots have inclined shoulders 58, 60, 62 which will automatically guide the lugs 56 into the linear groove 64 as the tool 20 is lowered into the borehole 30, assuming that one of the tool 20 or packer 28 is free to rotate relative to the other. In the preferred embodiment, the object engaging means 24 is a left hand J-slot, i.e., the tool must be rotated to the left or counter-clockwise as viewed from the top to remove the lug 56 from the J-slot 54.

In the prototype tool 20, referring to the example of FIGS. 1 and 2, the string engaging means 26 includes a J-slot 70 located in one of the upper end 52 of the mandrel 22 or in the drill string 32 or washover pipe 40; and a lug 72 located in the other of the upper end 52 of the mandrel 22 or in the drill string 32 or washover pipe 40.

To facilitate discussion, the string engaging means 26 will be referred to as located in the drill string 32, although it is intended to be understood that the term drill string, as used herein, includes the washover pipe 40, mill 42, or other device which may be mated with the upper end 52 of the mandrel 22 and which will accommodate the string engaging means 26.

Figure 9:
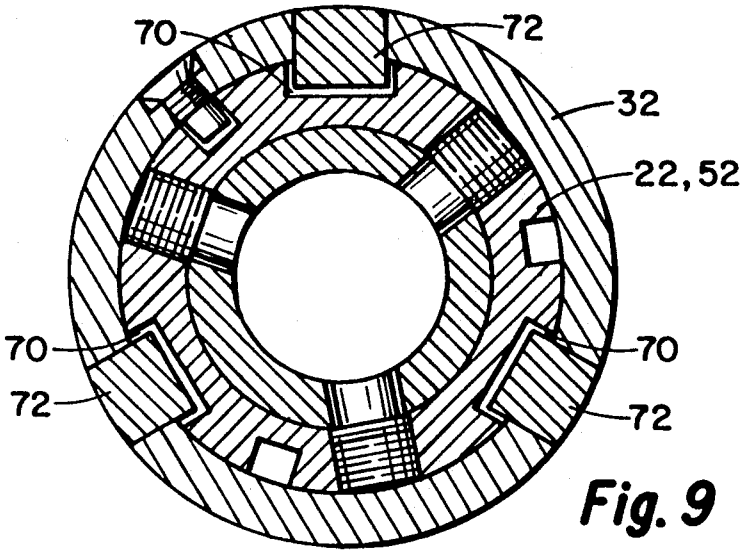
FIG. 9 is a cross-sectional view of an embodiment of the string engaging means taken along line 9—9 of FIG. 2.
Figure 7:
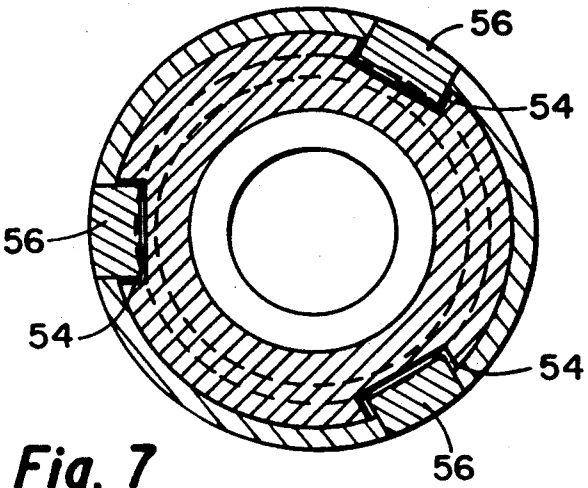

In the prototype tool 20, the lugs 72 are located in the inside surface of the drill string 32 and the J-slots 70 are located in the outside surface of the upper end 52 of the mandrel 22. Referring to FIG. 9, in the prototype tool 20, the string engaging means 26 includes three sets of J-slots 70 and lugs 72. The three J-slots 70 are spaced around the outside surface of the upper end 52 of the mandrel 22 in a common radial plane. The three lugs 72 are spaced around the inside surface of the drill string 32 in a common radial plane. Preferably, referring to FIG. 8, the J-slots 70 of the string engaging means are automatic J-slots, i.e., the J-slot 70 include inclined shoulders 74, 76, 78. The inclined shoulders 74, 76, 78 will automatically guide the lugs 72 into the linear grooves 80 of the J-slots 70 as the lugs 72 are lifted relative to the J-slots 70, as will be further discussed below, assuming one of the drill string 32 or mandrel 22 is free to rotate relative to the other. In the prototype tool 20, the J-slots 70 of the string engaging means 26 are right hand J-slots, i.e., the drill string 32 must be rotated to the right or clockwise as viewed from above to free the lugs 72 from the J-slots 70.

As previously mentioned, referring to the example of The tool includes a lateral port 141 n the mandrel 22 immediately below the J-slot 70. The lateral port 141 provides for fluid to flow into and out of the annulus area defined between the mandrel 22 and washpipe 32 when the washpipe 32 is moved downward (or upward) relative to the mandrel 22. Also, the tool contains the second lateral port 142, this port being located immediately above collar 138. This second lateral port 142 is also provided for fluid to flow into and out of the annulus area defined between the mandrel 22 and washpipe 32 when the washpipe 32 is moved downward (or upward) relative to the mandrel 22.

As previously mentioned, referring to the example of FIG. 5, in the preferred embodiment, the tool 20 includes ratchet means 44 for allowing the washover pipe 40 and mill 42 to move downward relative to the mandrel 22 as the object or packer 28 is milled. The ratchet means 44 also prevents the washover pipe 40 and mill 42 from moving upward relative to the mandrel 22 unless the drill string 32 is rotated in the first direction relative to the mandrel 22.

Preferably, the ratchet means 44 includes a pawl 84 located on one of the mandrel 22 and the drill string 32 and threads 86 located on the other of the mandrel 22 and the drill string 32 for engaging the pawl 84. Preferably, the threads 86 are left hand threads, i.e., the pawl 84 must be rotated to the left or counter-clockwise as viewed from above to move into deeper engagement with the threads 86 and must be rotated to the right to disengage from the threads 86. In the prototype ratchet means 44, referring to FIG. 10, the pawl 84 includes four pawl sections, also designated 84, which are spaced in a common plane around the inside surface of a ratchet housing 92. The pawls 84 have a threaded surface 88 which faces inward in the drill string 32. The pawls 84 are biased inwardly against the threads 86 on the outside surface of the mandrel 22 by pawl spring 90. The prototype ratchet housing 92 is threaded to the drill pipe 32 on one side and washover pipe 40 on the other, as exemplified in FIG. 5. The ratchet housing 92 includes four pockets 94 which house the pawls 84.

The manner of operation of the prototype retrieving tool 20 is as follows. If the packer 28 has a valve 102, such as the sliding sleeve valve 102 illustrated in FIG. 1, a stinger 100 is connected to the lower end 50 of the mandrel 22. The stinger 100 is used to open the valve 102 and to equalize the pressure on either side of the packer 28, as exemplified in FIG. 2. If there is no valve 102, the stinger 100 is not necessary although some type of stinger or spear 100 may be used to assist in guiding the lower end 50 of the mandrel 22 into the packer 28. Various types of stingers or spears 100 may be used as required to functionally cooperate with the various types of valves 102 which may be used in packers 28.

Figure 6:
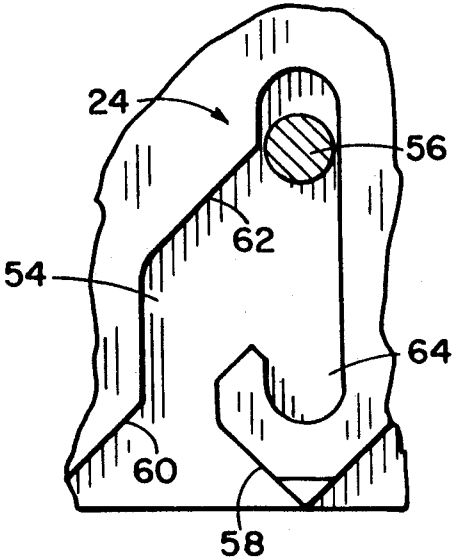
FIG. 6 is a view of an embodiment of the object means of the present invention.
Figure 10:
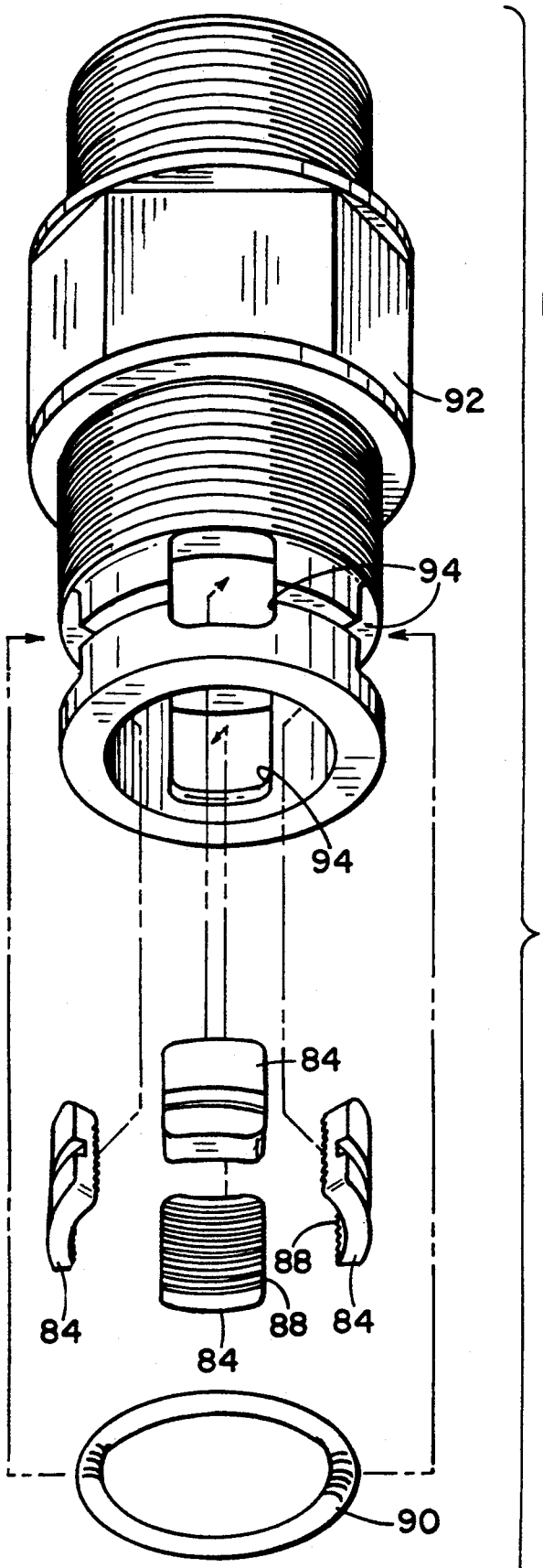
FIG. 10 is an exploded, perspective view of an embodiment of the ratchet means of the present invention.

The tubular tool 20 is connected to the lower end of a drill string 32. Preferably a threaded coupling 103 is used to connect the tool 20 to drill string 32. The drill string 32 is lowered into the borehole 30 until the stinger 100 enters the packer 28 and valve 102 and the lugs 56 in the packer 28 enter the J-slots 54 of the object engaging means 24, as exemplified in FIG. 2. Referring to FIG. 6, the inclined shoulders 58, 60, 62 of the J-slots 54 will automatically guide lugs 56 into the linear grooves 64. The packer 28 and lugs 56 will normally be securely lodged in the borehole 30 and the mandrel 22 and drill string 32 will be forced to rotate to the right or clockwise as the lugs 56 ride along the inclined shoulders 60, 62 into the linear grooves 64. The drill string 32 should be lowered until the mandrel 22 and drill string cannot be lowered further, which indicates that the lugs 56 are in the upper end of the linear grooves 64.

Figure 8:
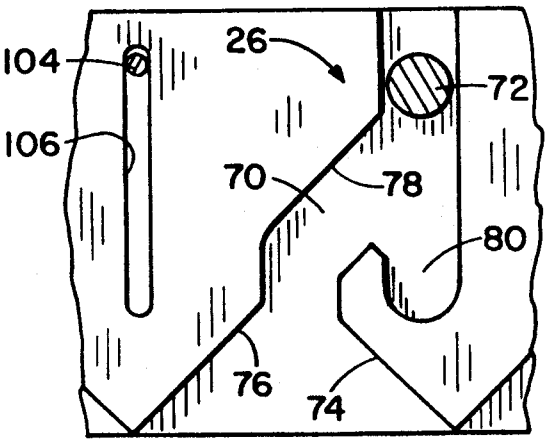
FIG. 8 is a cross-sectional view of an embodiment of the object engaging means taken along line 7—7 of FIG. 2.

Referring to FIG. 8, the drill string 32 is then lifted and turned to the right to disengage the lugs 72 of the string engaging means 26 from the linear grooves 80 of the J-slots 70. The lifting is necessary since the lugs 72 should be in the lower end of the linear grooves 80 after the drill string has been lowered until the mandrel 22 will lower no further. When the drill pipe 32 is turned to the right with the lugs 72 unrestrained by the sides of the linear grooves 80, the shear pin 104 in shear slot 106 will shear allowing the drill string 32 to rotate relative to the mandrel 22. The shear pin 104 is provided to prevent the drill string 32 from rotating relatively to the mandrel 22 as the tool 20 is lowered into the borehole 30. The length and width of the shear slot 106 should be sized such that the lugs 72 will engage the upper and lower ends of the linear grooves 80 and the sides of the upper and lower ends of the linear grooves 80 before the shear pin 104 engages the sides of the shear slot 106. This will allow the J-slots 70 and lugs 72 to bear the normal vertical loading and to bear the torsion of the tool 20 and drill string 32 when the lugs 72 are at either end of the linear grooves 80 of the J-slots 70. In other words, the shear pin 104 and shear slot 106 are designed so that the linear groove 80 and lug 72 carry the normal vertical and linear stresses as well as rotational torque when the tool 20 is being lowered into the borehole 30 or lifted from the borehole 30 since the lug 72 is at one of the extreme upper or lower ends of the linear grooves 80 during lifting and lowering of the tool 20. This feature is important in that the shear pin 104 should only shear when the drill string 32 is rotated to the right with the lugs 72 positioned in the middle area of the linear grooves 80.

Figure 4A:
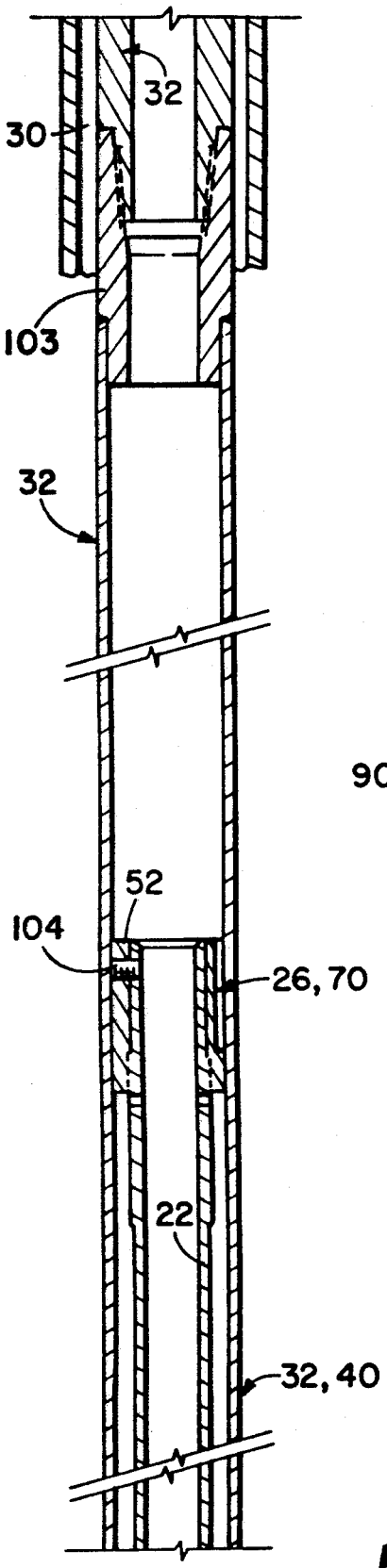
FIGS. 4*a*–4*c* are is another view of the tool of FIG. 1 in which the washover pipe and mill of the tool have been rotated and have cut sufficiently through the packer to release the packer from engagement with the borehole.
Figure 4B:
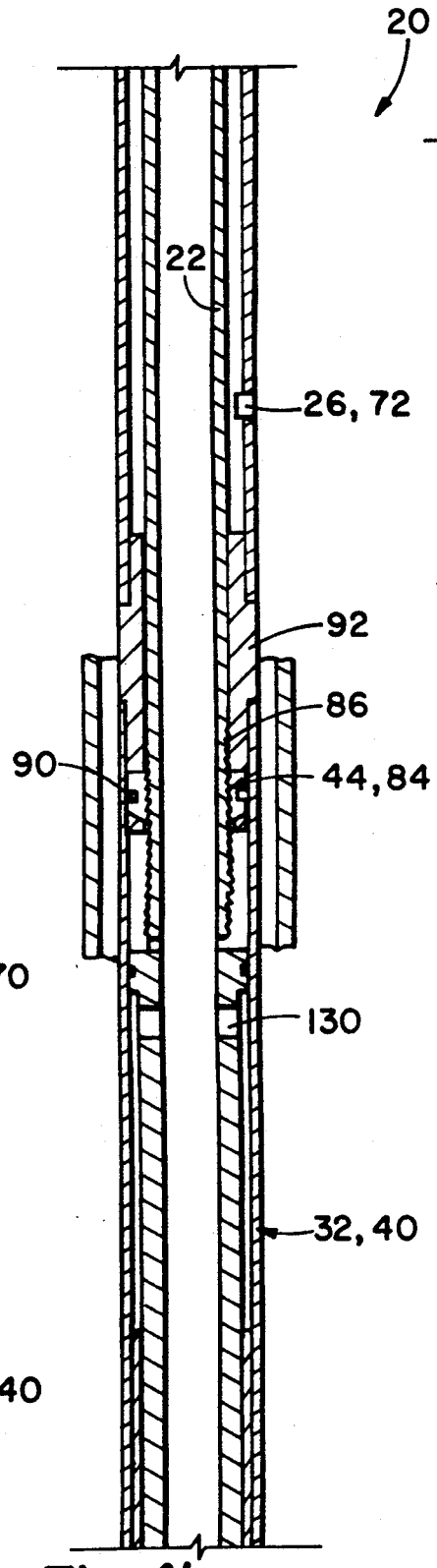
Figure 4C:
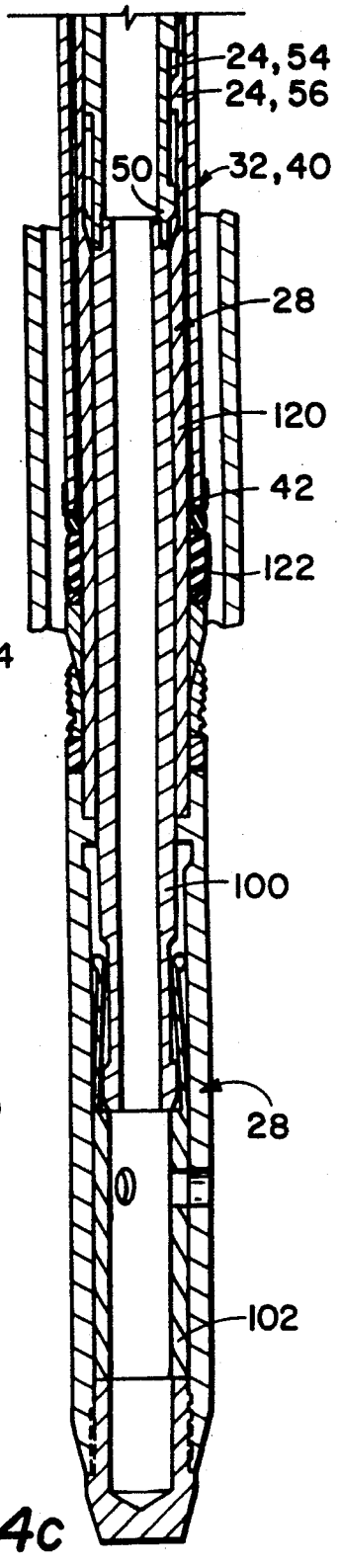

Referring to FIG. 3, after the drill string 32 is rotated to the right, the drill string 32 is lowered and lugs 72 pass out the lower end of J-slots 70 in order to disengage the drill string 32, washover pipe 40, and mill 42 from the mandrel 22. The drill string 32 is lowered until the lower end of the drill string, i.e., the mill 42, contacts the packer 28. The drill string 32 is then rotated to the right and the mill cuts through the outside of the packer mandrel 120, as illustrated in FIG. 4. As the mill 42 cuts through the outside of the packer mandrel 120, packer slips 121, and packer elements 122, the pawls 84 ratchet down over the threads 86, i.e., although the threads 86 are left hand threads requiring counter-clockwise rotation to increase engagement, the downward force of the drill string 32 causes the spring loaded pawls 84 to expand sufficiently to ratchet down and over the threads 86. The pawls 84, which are securely fastened to the washover pipe 40 and mill 42 by the ratchet housing 92, lock the washover pipe 40 and mill 42 against upward motion relative to the mandrel 22. This is important in that portions of the packer mandrel 120 and packer slips 122 are contained between the washover pipe 40 and the unmilled portions of the packer 28; and this containment prevents the unmilled loosened pieces from falling into the borehole 30.

Once the packer 28 is milled sufficiently to release it from the borehole 30, i.e., once the packer 28 has been milled sufficiently to relieve the pressure expanding the packer slips 122, the tool 20, packer 28, and debris contained between the tool 20 and packer 28 may be lifted out of the borehole. The ratchet means 44, by locking the washover pipe 40 and mill 42 over the packer 28, also stabilizes the milled packer 28 as the tool 20 is lifted out of the borehole 30 and reduces the likelihood that the motion of the tool 20 will unlatch the packer 28 from the mandrel 22 and allow the packer 28 to fall into the borehole 30.

If it is necessary to release the packer 28 before milling operations are complete, i.e., to free the tool 20 from the packer, the following procedures are followed. The drill string is lifted as it is turned to the right in order to unscrew the pawls 84 from the threads 86. The drill string should be lifted and turned to the right until resistance is encountered. At this point, the lugs 72 of drill string engaging means 26 have encountered the shoulders of the J-slots 70. The drill string 32 should next be rotated to the left and lifted until resistance is encountered in order to confirm that the lugs 72 have rotated into the linear grooves 80 of the J-slots 70 and that the mandrel 22 is engaged with the drill string 32. When resistance to left hand, or counter-clockwise, motion is encountered the drill string 32 should be lowered and turned to the left to remove the lugs 56 from the J-slots 54 of the object engaging means 24. Left hand rotation should be continued until resistance is encountered, indicating that the lugs 56 have engaged the shoulders 60, 62 of the J-slots 54, at which point the drill string should be lifted to release the tool 20 from the packer 28.

Figure 11:
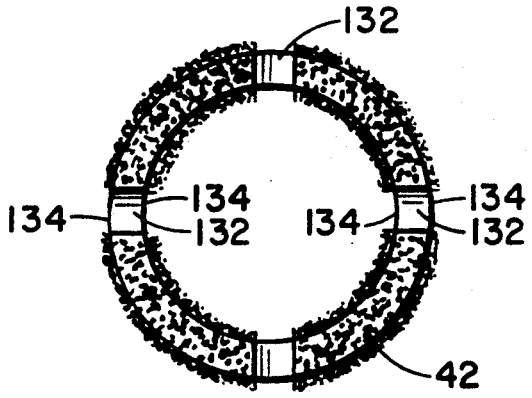
FIG. 11 is a bottom view of an embodiment of the mill of the present invention.

Drilling fluid should be circulated through the drill string 32 and tool 20 throughout the milling operation. Referring to FIG. 5, drilling fluid ports 130 are provided in the mandrel 22 to allow the drilling fluid to pass out of the mandrel and through the mill 42. Referring to FIG. 11, cut-outs 132 are provided at the lower end of the mill 42 and channels 134 are provided through the abrasive particles on both sides of the mill 42 to allow the drilling fluid to circulate through the drilling ports 130 and cut-outs 132 in order to carry the milled debris to the surface of the borehole 30.

Referring to the example of FIG. 5, the J-slot 70 of the string engaging means 26 are housed in a J-slot sleeve 136 which is fastened to the upper end 52 of mandrel 22. The ratchet housing 92 extends inwardly from the inside surface of the drill string 32 and washover pipe 40. The upper end of the ratchet housing 92 and the lower end of the J-slot sleeve 136 create a stop which limits the upward motion of the mandrel 22 relative to the drill string 32.

A collar 138 and an O-ring-type seal 140 are provided below the threads 86 and above the drilling fluid ports 130 in the mandrel 22. The O-ring seal 140 prevents the drilling fluid passing out of the mandrel 22 and through the mill 42 from the travelling upward through the annulus between the washover pipe 40 and the mandrel 22. The upper end of the collar 138 and the lower end of the ratchet housing 92 also form a stop which limits the downward travel of the drill string relative to the mandrel 22. The length of the washover pipe 40 and mill 42 below the ratchet housing 92 and the length of the mandrel 22 between the J-slot sleeve 136 and collar 138 must be long enough to pass along the length of the stinger 100 and to mill sufficiently through the packer 28 and packer slips 122 to release the packer 28 from the well bore 30.

While presently preferred embodiments of the invention have been described herein for the purpose of disclosure, numerous changes in the construction and arrangement of parts and in the performance of methods will suggest themselves to those skilled in the art, which changes are encompassed within the spirit of this invention as defined by the following claims.

What is claimed is:

1. A method of latching an object in a wellbore, the method comprising:

moving a mandrel into the wellbore with a drill string, the drill string containing at its lower end a mill;

latching the mandrel to the object as the tool is moved into the wellbore;

rotating the drill string in a first direction with the mandrel latched to the object in order to unlatch the mandrel from the drill string;

lowering the drill string to come in contact with the object;

rotating the drill string with the mill attached thereto, to mill the object;

moving the drill string away from the object and rotating the drill string in a second direction relative to the mandrel in order to latch the mandrel to the drill string; and moving the mandrel away from the object and rotating the mandrel in the second direction relative to the object in order to unlatch the mandrel from the object.

2. A tool attached to a drill string for removing an object from a wellbore, the tool comprises:

a mandrel having an upper and lower end; object engaging means, located at the lower end of the mandrel, for latching the mandrel to the object as the tool is lowered into the wellbore and for keeping the mandrel latched to the object when the mandrel is raised, lowered, or rotated in a first direction relative to the object, said object engaging means comprising a J-slot located in one of the lower end of the mandrel and the object, and a lug located in the other of the lower end of the mandrel and the object;

string engaging means, located at the upper end of the mandrel, for keeping the mandrel latched to the drill string as the mandrel is lowered into the wellbore and for unlatching the mandrel from the drill string when the drill string is raised and then lowered and rotated in the first direction with the mandrel latched to the object, said string engaging means comprising a J-slot located in one of the upper end of the mandrel and the drill string, and a lug located in the other of the upper end of the mandrel and the drill string; a washover pipe connected to the drill string; and a mill, connected to the washover pipe, so that the mill may be lowered into contact with the object after the mandrel is unlatched from the drill string.

3. A tool of claim 2, further comprising:

ratchet means for allowing the washover pipe and mill to move downward relative to the mandrel as the object is milled and for preventing the washover pipe and mill from moving upward relative to the mandrel unless the drill string is rotated in the first direction relative to the mandrel.

4. The tool of claim 2 wherein the ratchet means comprises:

a pawl located on one of the mandrel in the drill string; and threads located on the other of the mandrel and the drill string for engaging the pawl.

5. A tool attached to a drill string for capturing an object in a wellbore, the tool comprising:

a mandrel;

object engaging means for latching the mandrel to the object as the tool is moved into the wellbore;

string engaging means for keeping the mandrel latched to the drill string as the mandrel is moved into the wellbore and for unlatching the mandrel from the drill string when the drill string is rotated in a first direction with the mandrel latched to the object; and means for latching the mandrel to the drill string when the drill string is moved away from the object and rotated in a second direction relative to the mandrel, said means for latching the mandrel located on said string engaging means.

6. The tool of claim 5, further comprising:

means for unlatching the mandrel from the object when the mandrel is moved away from the object and rotated in a second direction relative to the object, said means for unlatching the mandrel located on said object engaging means.

7. A tool attached to a drill string for removing an object from a wellbore, the tool comprising:

a mandrel having an upper end and a lower end;

object engaging means, located at the lower end of the mandrel, for latching mandrel to the object as the tool is lowered into the wellbore and for keeping the mandrel latched to the object when the mandrel is raised, lowered, or rotated in a first direction relative to the object;

string engaging means, located at the upper end of the mandrel, for keeping the mandrel latched to the drill string as the mandrel is lowered into the well bore and for unlatching the mandrel from the drill string when the drill string is raised and then lowered and rotated in the first direction with the mandrel latched to the object;

a washover pipe connected to the drill string;

a mill, connected to the washover pipe, so that the mill may be lowered into contact with the object after the mandrel is unlatched from the drill string;

means for latching the mandrel to the drill string when the drill string is raised and rotated in a second direction relative to the mandrel said means for latching the mandrel being located o the string engaging means; and means for unlatching the mandrel from the object when the mandrel is raised and rotated in the second direction relative to the object, said means for unlatching the mandrel being located on the string engaging means.

* * * * *